US006729094B1

(12) United States Patent
Spencer et al.

(10) Patent No.: US 6,729,094 B1
(45) Date of Patent: May 4, 2004

(54) PRE-FABRICATED BUILDING PANELS AND METHOD OF MANUFACTURING

(75) Inventors: Alicia Spencer, Houston, TX (US); Erwin Ritter, Houston, TX (US)

(73) Assignee: Tex Rite Building Systems, Inc., Houston, TX (US)

( * ) Notice: Subject to any disclaimer, the term of this patent is extended or adjusted under 35 U.S.C. 154(b) by 0 days.

(21) Appl. No.: 10/372,377

(22) Filed: Feb. 24, 2003

(51) Int. Cl.[7] ..... E04B 5/18

(52) U.S. Cl. ..... 52/414; 52/354; 52/334; 52/600

(58) Field of Search ..... 52/414, 344, 354–357, 52/334, 454, 293.1, 742.14, 319, 600

(56) References Cited

U.S. PATENT DOCUMENTS

| | | | | | |
|---|---|---|---|---|---|
| 3,744,197 | A | | 7/1973 | Wetzel, Jr. | |
| 3,767,232 | A | | 10/1973 | Smith | |
| 3,919,812 | A | * | 11/1975 | van der Lely et al. | 52/79.1 |
| 4,001,990 | A | | 1/1977 | Chase et al. | |
| 4,059,362 | A | | 11/1977 | Smith | |
| 4,059,939 | A | * | 11/1977 | Elliott | 52/745.11 |
| 4,113,400 | A | | 9/1978 | Smith | |
| 4,432,175 | A | | 2/1984 | Smith | |
| 4,472,919 | A | * | 9/1984 | Nourse | 52/601 |
| 4,525,965 | A | * | 7/1985 | Woelfel | 52/309.17 |
| 4,590,717 | A | | 5/1986 | Ruiz et al. | |
| 4,602,467 | A | * | 7/1986 | Schilger | 52/319 |
| 4,779,673 | A | * | 10/1988 | Chiles et al. | 165/45 |
| 4,866,897 | A | * | 9/1989 | Yount | 52/363 |
| 4,885,884 | A | * | 12/1989 | Schilger | 52/354 |
| 4,909,001 | A | | 3/1990 | Gonzalez Espinosa de | |
| 5,055,252 | A | | 10/1991 | Zimmerman | |
| 5,149,224 | A | | 9/1992 | Smith | |
| 5,414,972 | A | | 5/1995 | Ruiz et al. | |
| 5,699,644 | A | | 12/1997 | Smith | |
| 5,758,463 | A | | 6/1998 | Mancini, Jr. | |
| 5,875,595 | A | | 3/1999 | Smith | |
| 5,927,034 | A | * | 7/1999 | Cole | 52/391 |
| 6,041,561 | A | * | 3/2000 | LeBlang | 52/234 |
| 6,123,888 | A | | 9/2000 | Smith | |
| 6,216,405 | B1 | | 4/2001 | Smith | |
| 6,434,900 | B1 | | 8/2002 | Masters | |

FOREIGN PATENT DOCUMENTS

| | | | |
|---|---|---|---|
| GB | 2246148 | * | 1/1992 |

* cited by examiner

*Primary Examiner*—Winnie S. Yip
(74) *Attorney, Agent, or Firm*—Jenkens & Gilchrist, P.C.

(57) ABSTRACT

A prefabricated concrete panel for use in forming the walls, floor, roof, ceiling, and/or foundation of a building is provided. The prefabricated concrete panel includes a concrete slab, a metal mesh embedded in the slab, an insulating panel adjacent to a surface of the concrete slab, one or more studs, upper and lower U-shaped tracks, and one or more connectors attached to the studs. A method of making the prefabricated concrete panels and a method of constructing a building using the prefabricated concrete panels are provided.

41 Claims, 7 Drawing Sheets

PRE-FABRICATED BUILDING PANELS AND METHOD OF MANUFACTURING

CROSS REFERENCE TO RELATED APPLICATIONS

Not applicable.

FEDERALLY SPONSORED RESEARCH

Not applicable.

REFERENCE TO MICROFICHE APPENDIX

Not applicable.

FIELD OF THE INVENTION

The invention relates generally to pre-fabricated building panels and a method of manufacturing the panels. More particularly, the invention relates to a method of manufacturing pre-fabricated panels wherein the exterior concrete surface is accessible during curing of the concrete and a pre-fabricated panel made from such method.

BACKGROUND OF THE INVENTION

Pre-fabricated building panels, usually constructed from concrete and studs, have been used to form the walls, floors and roofs of a building structure for many years. Such pre-fabricated building panels act as structural components of the building. Construction utilizing pre-fabricated panels offers many advantages, including more rapid construction and standardization, than traditional on-site construction. Rapid construction allows lower construction financing costs. Pre-fabricated building panels can be constructed on or off-site and then moved into position to form the walls, floors and roofs of the building structure. While pre-fabricated building panels have been frequently used for commercial buildings, they have been less popular for residential use. One reason for their unpopularity for residential use is the difficulty of achieving a wide-range of pleasing textures and colors on the exposed exterior surface of the finished panel. Moreover, buildings constructed of many currently available pre-fabricated panels are restricted in choice of interior wall material. Other reasons for the unpopularity of pre-fabricated building panels for residential construction is the difficulty in providing thermal and acoustic insulation with existing panels. Nevertheless, there remains an interest in housing construction methods which possess the advantages of prefabricated panels. There remains a need, therefore, for pre-fabricated building panels and method of making such panels that can be textured and colored with great variety yet easily and economically.

It is generally believed that the strength of a pre-fabricated building panel increases, inter alia, with the integrity of the bond or connection between the studs and tracks and the concrete panel. A number of methods have been used to increase the integrity of the concrete/stud bond. For the purpose of our discussion, we refer to studs and tracks collectively as studs.

In some pre-fabricated panels, the studs are partially or wholly embedded in the concrete panel. However, such panels are subject to cracking of the concrete due to stresses caused by flexing of the studs. Such stresses are a particular problem where the studs are screwed, but not welded, together or where no metal mesh is used within the concrete. Such panels are also subject to separation between the studs and concrete. The interior walls of buildings constructed of pre-fabricated panels are generally constructed by attaching sheet rock or other type of interior paneling to the studs. Consequently, where the studs are partially or wholly embedded in the concrete, the area in which insulation may be placed is either reduced or eliminated.

Other common techniques for improving the integrity of the concrete/stud bond provide a wide variety of connectors which are attached to the stud and embedded in the concrete. In order to embed the connectors, but not the studs, in the concrete, a stud framework, having connectors extending from the studs, is suspended above a poured concrete panel such that the connectors are embedded in the wet cement. In such manufacturing methods, the exterior face of the panel is face down in the form and, therefore, is not accessible during curing.

One example of a pre-fabricated panel utilizes a reinforcing member which is a metal strip having alternating hooked projections. The reinforcing member is attached to a central portion of a stud and runs along the length of the stud. The hooked projections hook over rods which secure a wire mesh within the concrete. The reinforcing member becomes a part of the stud forming a reinforced structural member. Although the reinforcing member may add additional strength to the studs, it adds significantly to the cost of the structural panel and adds significantly to labor costs due to the need to make extensive connections along the lengths of the studs. Moreover, the reinforcing member adds an unacceptable amount of rigidity thereby increasing risks of cracking of the concrete.

Yet other methods of increasing the strength of the concrete/stud bond employ connectors which are integrally molded into the studs. Such methods utilize specially manufactured studs in which the top flange has been modified to include projections which act as connectors. Such specially manufactured studs, of course, are more expensive then standard "C"-shaped and "I"-shaped studs.

Other pre-fabricated panels require that a metal framework be first constructed at the job site. The pre-fabricated panels are then attached to the framework. Yet other pre-fabricated panels are constructed of metal mesh and/or rebar reinforced concrete slabs. Such slabs are tilted up into place and attached to the foundation to form the walls of a building. Reinforced concrete slab panels, however, must have a thickness sufficient to support their own weight and the weight of the roof Consequently, reinforced concrete slab panels have thicknesses of at least about four (4) inches, making the panels extremely heavy and difficult to handle. To support the weight of thick reinforced concrete slab panels, the foundation of a building constructed in this manner must also be thicker and heavily reinforced.

Each of the previously described pre-fabricated building panels are not desirable choices for residential construction. First, panels in which the studs are wholly or partially embedded cannot be easily or sufficiently insulated. Indeed, those with wholly embedded joists offer no insulating opportunity because the interior wall boards are attached directly to the exposed stud flange surface. Although some amount of insulation may be placed between wall boards and the interior concrete surface where the studs are partially embedded, the thickness of such insulation is generally limited to about 3 inches or less.

Second, the appearance of the outside concrete surface is severely limited in existing concrete structural panels. For example, those pre-fabricated panels using connectors are usually made in a manner in which the concrete is poured face down in a mold. Because the concrete face of the panel is not accessible during curing, the options for texturing and coloring the face are limited. For example, if it is desired that the face have a color other than the normal color of undyed concrete, dye must be added to the whole of the concrete or the face may be colored after curing. Both of these coloring methods are unnecessarily expensive in view of methods for coloring concrete surfaces during curing. Moreover, post-cure coloring techniques often require an acid etch which involves hazardous chemicals and special handling.

To add texture to the face of panels poured face-down is also unnecessarily difficult and expensive. One way of providing texture to the exterior face of such panels is the use of textured plastic molds. These molds, however, are expensive, driving up the costs of the structural panels significantly. Alternatively, some simple textures may be imparted to the panel face after curing using acid-etching. This technique is also expensive, involving hazardous chemicals and specialized handling requirements. Furthermore, none of these coloring or texturing methods permit one to see how the finished product will look until the result is irreversible. Consequently, if the resulting color or texture is undesirable, the entire pre-fabricated panel must be discarded.

Finally, some of the existing pre-fabricated panels require specially manufactured parts or require extensive labor to manufacture, thereby driving up the costs of the finished panels. Thus, such methods and panels do not provide the anticipated low-cost housing alternative. Moreover, existing pre-fabricated panel systems are generally difficult to assemble into a building at the job site, requiring extensive labor. Yet other existing pre-fabricated panel systems require exceptionally thick foundations or the construction of metal frameworks, all of which significantly increase the cost of construction.

There exists a need therefore for a concrete structural panel and a method of manufacturing the panel which may be insulated sufficiently well for residential use. There exists a further need for a method and panel which permits the exterior face of the panel to be colored and textured economically, safely and with controllable results.

SUMMARY OF THE INVENTION

The invention meets these and other needs by providing pre-fabricated structural panels including a concrete slab, a metal mesh embedded in the slab, an insulating panel, one or more studs adjacent to the insulating panel, an upper U-shaped track wrapping around the top edge of each stud and attached to each stud, and a lower U-shaped track wrapping around the bottom edge of each stud and attached to each stud, and one or more connectors hooked over the metal mesh.

The invention also provides a method of making the prefabricated structural panel and a method of constructing a building using the prefabricated panels. These and other aspects and advantages of the invention will be apparent from the description of the embodiments of the invention below.

DESCRIPTION OF EMBODIMENTS OF THE INVENTION

Figure 1:
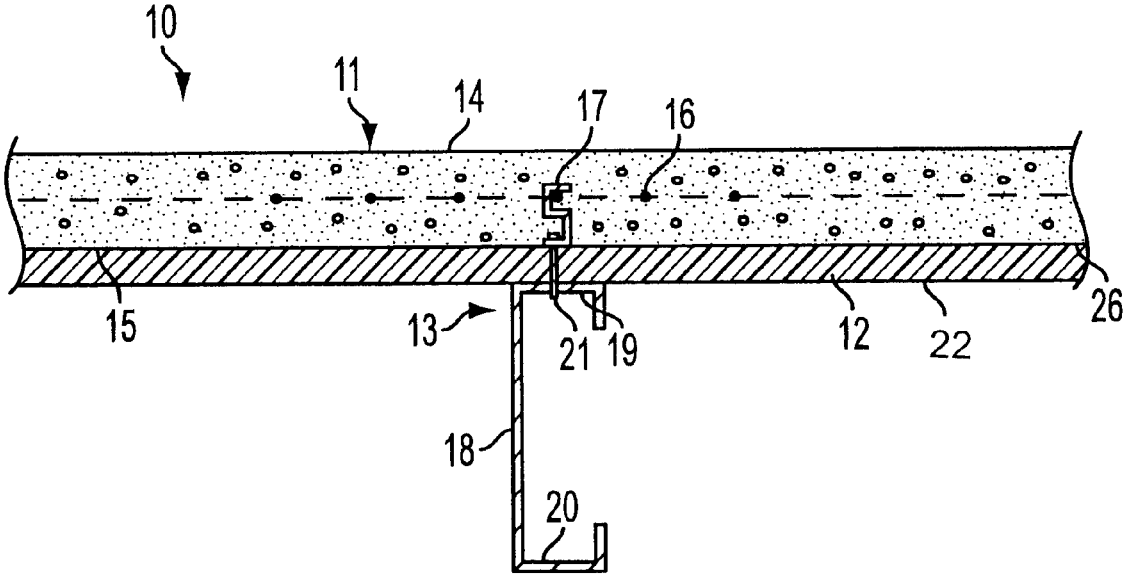
FIG. 1 is a cross-section of an embodiment of the pre-fabricated panel.
Figure 5:
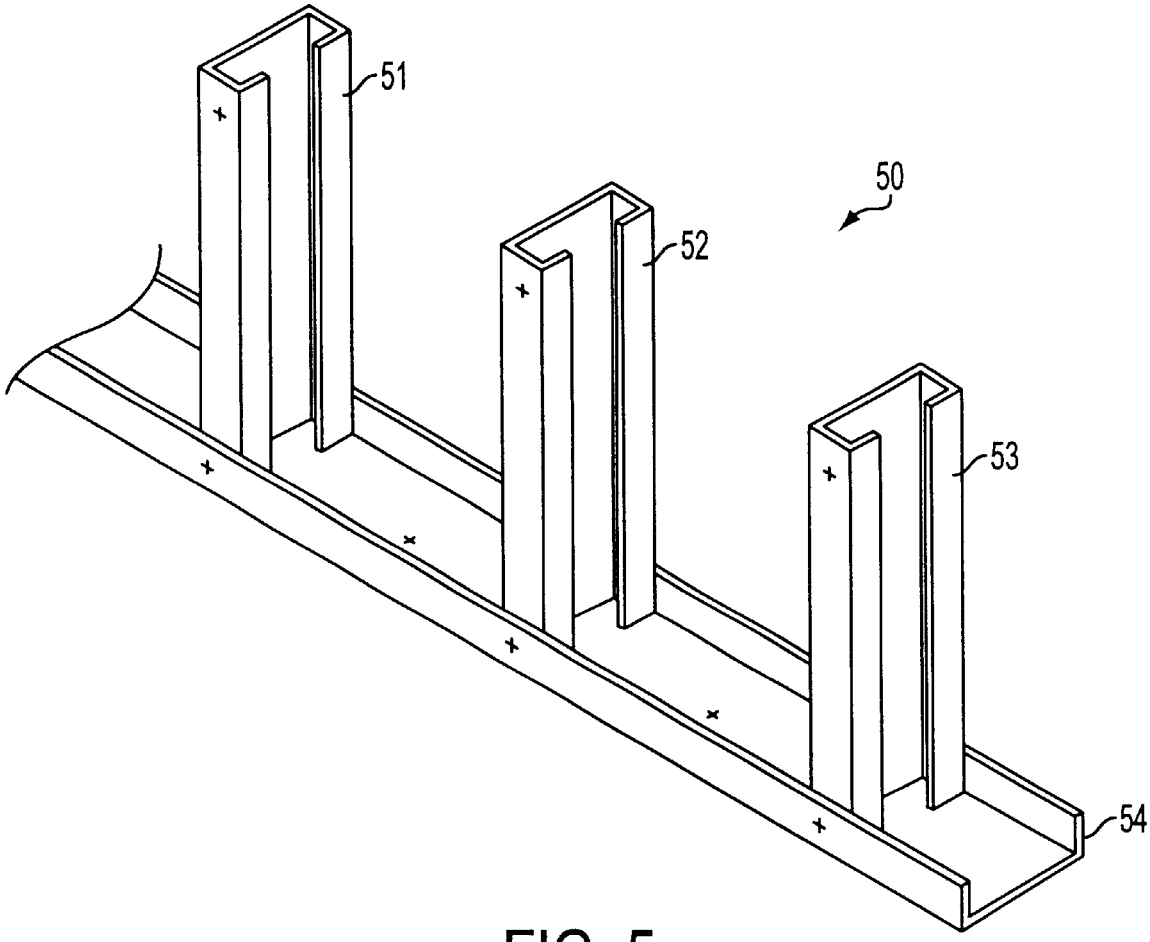
FIG. 5 is a perspective view of a load bearing partition wall configuration.

A first embodiment of the pre-fabricated panel is shown in FIG. 1 in cross-section. The pre-fabricated panel 10 has a planar concrete slab 11, an insulating panel 12 and a plurality of studs 13. The concrete slab 11 has an exterior face 14 and an interior surface 15 which are substantially parallel to each other. Embedded within the concrete slab and lying substantially parallel to the exterior face 14 and interior surface 15 of the concrete slab is a metal mesh 16. The studs 13 are connected to the concrete slab II through use of connectors 17. The connectors 17, as shown in FIG. 1, are "S"-shaped and provide the means for minimizing both the horizontal and vertical movement of the metal mesh 16 while the concrete is poured and cured. "Z," "C," and inverted "L"-shaped connectors may also be used. However, while the "C" and inverted "L" connectors can maintain the lateral position of the mesh during pour and cure of the cement, chairs may also be needed to maintain the vertical position of the mesh. The studs 13, when the panel is used to construct a wall, extend horizontally. Referring to FIG. 5, it can be seen that an lower U-shaped track 54 wraps over a bottom edge of the studs 13 and generally extends along the width of the pre-fabricated panel 10. Similarly, an upper U-shaped track wraps over a top edge of the studs 13. Lower and upper U-shaped tacks are attached to each of the studs through use of any of a variety of fasteners, including screws and rivets, fastening means, such as welding or epoxy bonding, or a combination of fasteners and fastening means.

Referring again to FIG. 1, the studs 13 are integral, or unitary members, each stud having an elongated portion 18 and upper 19 and lower 20 flange portions. Studs having a variety of shapes may be used, including for example, the "C" shaped studs shown in FIG. 1 and "I" shaped studs. The connectors 17 are attached to the upper flange portions 19 of the studs 13. Such connection may be made through use of fasteners 21, such as screws, nails and rivets, or by fastening means, such as welding or epoxy bonding. FIG. 1 illustrates the use of fasteners 21.

The studs and U-shaped tracks may be made of any appropriate material, including without limitation, galvanized steel, stainless steel, fiber reinforced plastics and composites. The thickness or gauge of such materials may vary depending upon the size of the panels, thickness of the concrete and strength requirements. Similarly, the dimensions of the studs and U-shaped tracks may vary depending upon the amount of insulating capacity desired, strength requirements, and availability. Generally, standard size and gauge galvanized steel studs and U-shaped tracks having dimensions of, for example, about 2 inches by 4 inches to about 2 inches by 8 inches and 10–26 gauge, preferably 16 or 18 gauge are used.

Insulating panel 12 may be constructed of any material which provides thermal and/or acoustical insulation including, for example, polymeric materials, such as polystyrene, polyurethane, recycled rubber materials such as chipped or ground tires, and composites. More preferably, rigid polymeric foams, such as polystyrene or polyurethane foam, is used. An aluminum foil coating or sheeting may be used along the entire exposed surface 22 of the insulating panel 12.

A vapor barrier 26 may be used between interior surface 15 of the concrete panel 14 and the insulating panel 12. Thus, vapor barrier 26 is generally co-planar with both the interior surface 15 of the concrete panel 14 and the unexposed surface of insulating panel 12. Suitable materials for the vapor barrier include, for example, polyethylene, polypropylene, tar paper, fiber reinforced polyethylene, and fiber-reinforced polyurethane sheeting. Vapor barriers having forms other than flat sheeting may also be used. For example, an impermeable, polymeric, dimpled sheet may be used to both function as a vapor barrier and to provide channeling of condensed moisture downward and away from the panel. Such enhanced vapor barrier products may also provide additional insulating capabilities.

Where an aluminum foil coating or sheeting 25 and vapor barrier 26 are both employed, the insulating panel may be produced as an integral insulating panel by lamination of the aluminum foil sheeting and vapor barrier sheeting onto an extruded polyurethane or polystyrene panel.

Metal mesh 16 may be constructed of any suitable metal and gauge for use to strengthen the cured concrete panel 11. Such metals include, for example, eleven gauge galvanized steel. The metal mesh may have a wide variety of mesh sizes. Preferably a metal mesh having approximately 2 by 2 inch mesh size is used.

The concrete panel may range from between about 1.5 and about 2.5 inches thick, its thickness dependent upon the particular application and the strength and flexibility requirements. The thickness of the cured concrete panel is more preferably between about 1¾ and 2.5 inches and most preferably between about 1⅞ and 2¼ inches. For increased flexibility, one or more additives, such as polymeric fibers may be added to the cement mix. Moreover, lightening additives may be added to the cement mix so that the cured concrete slab is lighter than if no such additive were included. Such lightening additives include, for example, perlite and aerated glass. Other additives may also be employed, including for example hardeners and retardants.

The prefabricated panels are assembled and joined together to construct a building and may be used to form the walls, floors, roof and/or ceiling panels of the structure. A variety of methods may be used to join the pre-fabricated panels, including the use of fasteners, such as screws and rivets, fastening means, such as welding and bonding, or a combination of fasteners and fastening means. To seal the joint, a sealant may be applied along the joint. Such sealants include, for example, silicone-based caulks, acrylic-based caulks, and epoxy-based sealants.

Moreover, the prefabricated panels may be used to form the foundation of a structure. For such use, the pre-fabricated panels would be, for example, buried in the ground in an upright position.

Figure 2:
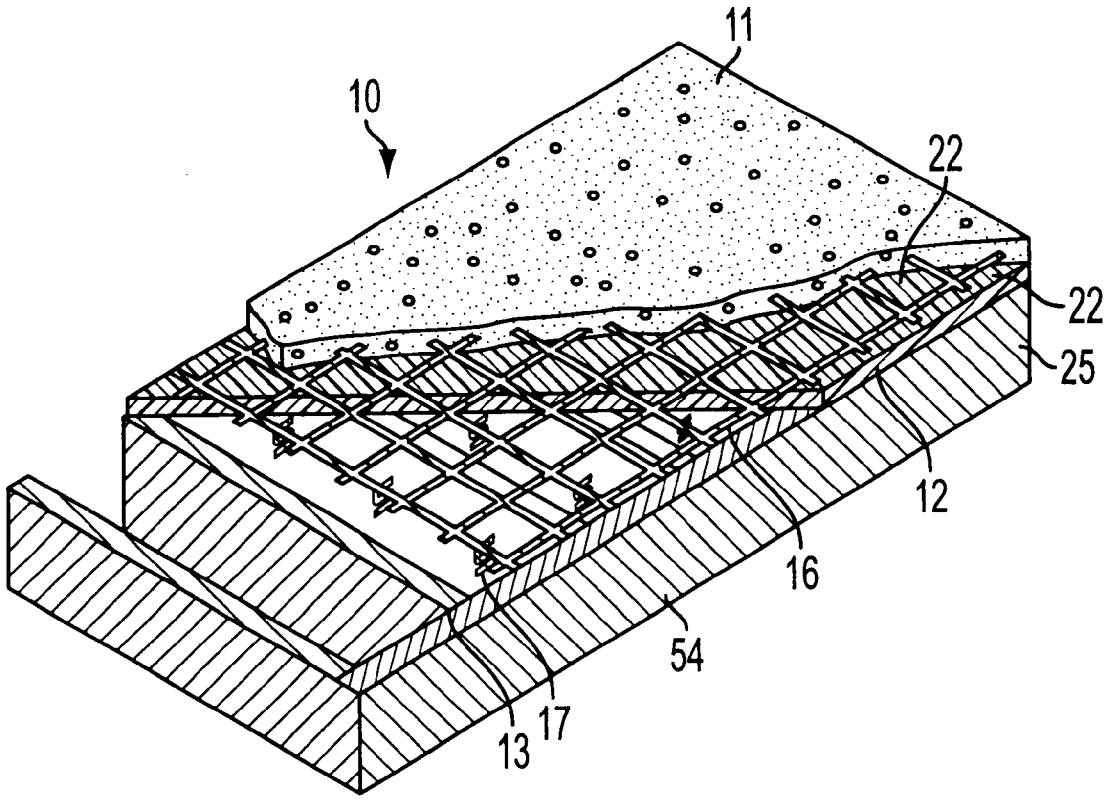
FIG. 2 is a perspective view of a partially cross-sectioned reinforced concrete panel wall or floor.

Referring to FIG. 2, a partial cross-section,of pre-fabricated panel 10 is shown. Reference to FIG. 2 is useful in describing the method of making the pre-fabricated panel. A panel frame 25 is formed by joining the required number of studs 13 to upper and lower tracks 55 and 54. If the final pre-fabricated panel is to have openings for windows or doors, the studs may be joined so as to provide for such openings. A concrete form (not shown) is constructed of any suitable material, including wood, metal, plastic or fiber-glass. Concrete form extends upward from a top surface 22 of insulating panel 12. Concrete form may be temporarily attached to the outermost studs and to the upper and lower tracks, may be of sufficient height to rest on the ground or may be held in place by resting it on blocks of an appropriate height. An insulating panel—having substantially the same dimensions as the panel frame 25 is laid over the panel frame 25. One ore connectors 17 are attached to the top flange(s) of the studs 13 forming the panel frame 25. The connectors 17 pass through the insulating panel 12. A metal mesh 16 having substantially the same dimensions as the insulating panel 12 and panel frame 25 is placed over the metal connector(s) 17 and engages the hook portion(s) of the connector) 17. Cement is then poured into the cement form and allowed to cure before removing thee cement form thereby forming concrete panel 11.

The insulating panel 32 acts as a bottom surface to and supports the concrete during pouring and curing.

Figure 3:
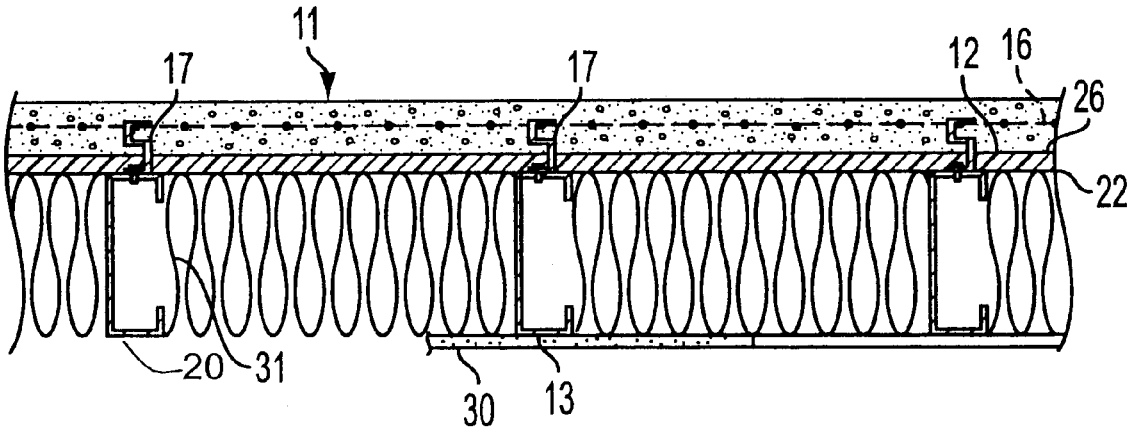
FIG. 3 is a cross-section of the pre-fabricated panel as used in a building, showing insulation and wall board installation.

Referring now to FIG. 3, a cross section view of the pre-fabricated panel in use in a building wall is shown. Interior wall boards 30 are attached to the lower flanges 20 of the studs 13. Between the interior wall boards 30 and the outer surface 22 of the insulating panel 12 is insulation material 31. Interior wall boards 30 may be of any suitable material, such as, for example, gypsum board and paneling. Insulation material 31 may be of any suitable insulating material, such as, for example, polyurethane foam, styrofoam, cellulose, glass fiber and glass wool Insulation material 31 may be of any thickness equal to or less than the distance between the interior wall boards 30 and the exposed surface 22 of the insulating panel 12 and will depend upon the degree of insulation required for the building.

Figure 4:
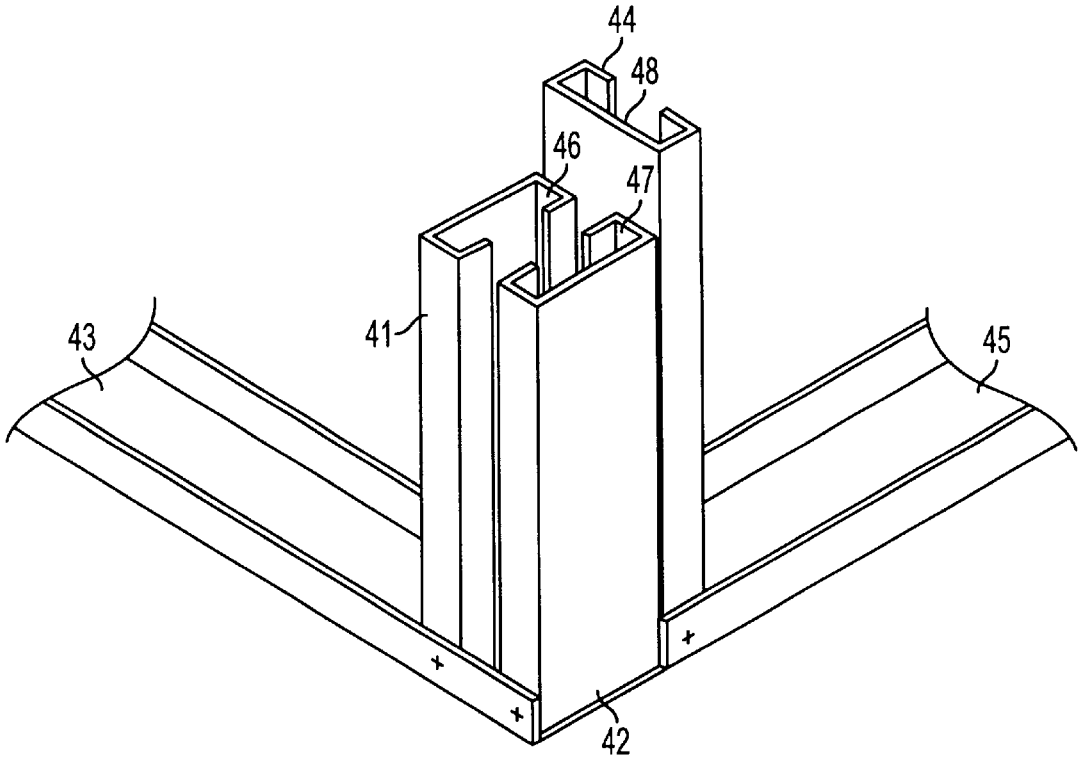
FIG. 4 is a perspective view of a load bearing three stud corner configuration.

Referring to FIG. 4, a configuration of lower U-shaped tracks and studs for use in forming a corner of a load bearing wall is shown. In the configuration shown in FIG. 4, two horizontal studs 41 and 42 are joined at an end portion of a first lower U-shaped track 43.

A third horizontal stud 44 is joined to a second lower U-shaped track 45. The third horizontal stud 44 is then joined to each of the first and second horizontal studs 41 and 42 by joining flange portions 46 and 47 to longitudinal portion 48. Each of the joints shown in FIG. 4 may be made as discussed above.

FIG. 5 illustrates a partial panel frame 50 in which the lower portions of three horizontal studs 51, 52 and 53 are joined within a lower U-shaped track 54. These joints may be made as discussed above.

Figure 6A:
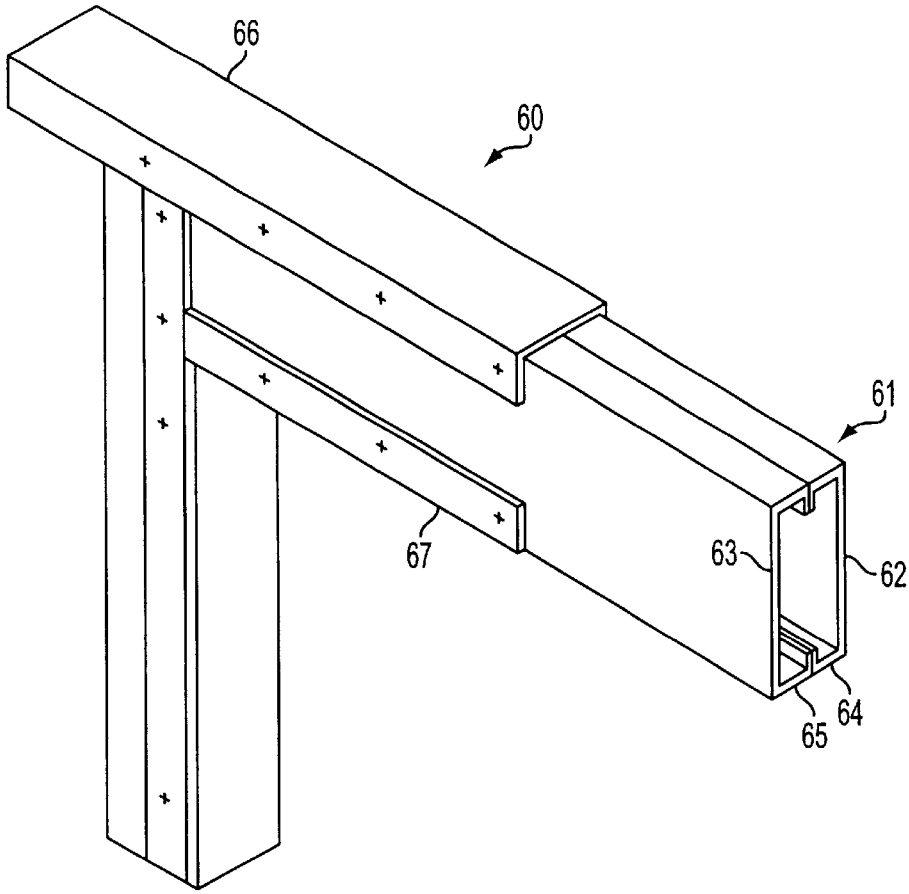
FIG. 6A is a perspective view of a load bearing wall header configuration.

FIG. 6A illustrates the formation of a load bearing wall header 60. A joist header portion 61 is made of two studs 62 and 63 joined longitudinally together along their flange portions 64 and 65.

Figure 6B:
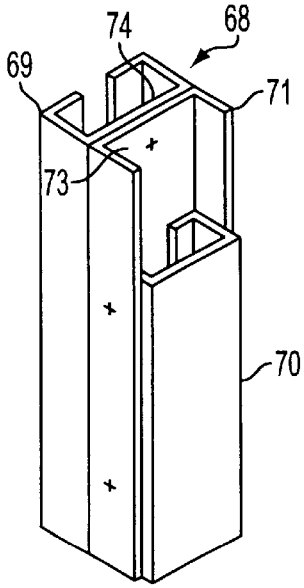
FIG. 6B is a perspective view of a door or window jamb assembly.
Figure 7A:
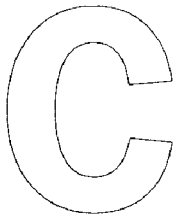
FIG. 7A is a side view of a "U" shaped connector.
Figure 7B:
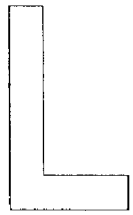
FIG. 7B is a side view of a "L" shaped connector.
Figure 7C:
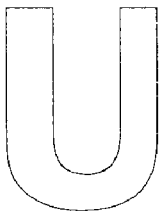
FIG. 7C is a side view of a "C" shaped connector.
Figure 7D:
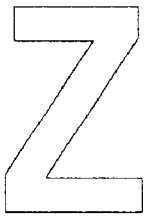
FIG. 7D is a side view of a "Z" shaped connector.

Upper and lower U-shaped tracks 66 and 67 are placed over and under and joined to the joined studs 62 and 63. The jamb assembly portion 68 is shown in detail in FIG. 6B. The jamb portion 68 is made of two studs 69 and 70 and one U-shaped track 71. Stud 70 nested within and joined to U-shaped track 71 with longitudinal portions 72 and 73 opposing each other. Stud 69 is joined to U-shaped track 71 along their respective longitudinal portions 74 and 73. Stud 70 is shorter than U-shaped track 71 so as to allow an end of joist header portion 61 to be inserted into a top portion of U-shaped track 71.

It will be further understood that other variations of the assemblies illustrated in FIGS. 4–6 may be used such that the strength and configuration requirements are met.

It will be understood that the pre-fabricated panel and method for manufacturing the panel have been described with reference to specific materials of construction and dimensions. However, other suitable materials and dimensions may be substituted for those mentioned herein while yet encompassing the intended scope of the invention.

What is claimed is:

1. A pre-fabricated structural panel comprising:

a concrete slab having a thickness and substantially parallel inner and outer surfaces;

a metal mesh embedded in the slab and being substantially parallel to the inner and outer surfaces of the concrete slab;

an insulating panel having substantially parallel unexposed and exposed surfaces wherein the unexposed surface of the insulating panel lies adjacent to the inner surface of the concrete slab;

one or more studs having top and bottom edges and an elongated section flanked by upper and lower flange portions wherein the upper flange lies adjacent to the exposed surface of the insulating panel;

an upper U-shaped track wrapping around the top edge of each stud and attached to each stud;

a lower U-shaped track wrapping around the bottom edge of each stud and attached to each stud; and one or more connectors, each connector having a hook portion, the hook portion hooked over the metal mesh, wherein the connectors are fixedly attached to the upper flanges of the studs and wherein such connectors are not unitary with the studs.

2. The structural panel of claim 1 wherein connectors are attached along the length of each stud at intervals from between about 6 inches to 12 inches.

3. The structural panel of claim 1 wherein the metal mesh is an eleven gauge galvanized steel mesh.

4. The structural panel of claim 3 wherein the metal mesh is a 2×2 inch mesh.

5. The structural panel of claim 1 wherein the concrete slab further comprises one or more additives selected from the groups of strengtheners, weatherizers, lightening agents, anti-corrosion additives, and colorants.

6. The structural panel of claim 1 wherein the insulating panel is made of a polystyrene.

7. The structural panel of claim 1 wherein the studs are galvanized steel.

8. The structural panel of claim 1 further comprising a vapor barrier between the inner surface of the concrete slab and the unexposed surface of the insulating panel.

9. The structural panel of claim 8 wherein the vapor barrier is a dimpled polymeric material.

10. The structural panel of claim 8 wherein the vapor barrier is selected from the group of polyethylene, polypropylene, fiber-reinforced polyethylene, and fiber-reinforced polypropylene.

11. The structural panel of claim 1 wherein an aluminum foil sheet is attached to the exposed surface of the insulating panel.

12. The structural panel of claim 1 wherein the insulating panel is about ¾ inch thick.

13. The structural panel of claim 1 wherein the concrete slab is between about 1⅞ and 2¼ inches thick.

14. The structural panel of claim 1 wherein the connector is an "S"-shaped connector having top and bottom loop portions.

15. The structural panel of claim 14 wherein the "S" connector is attached to the upper flange of the metal stud by a fastener passing through the bottom loop portion of the connector, the insulating panel and the upper flange of the stud.

16. The structural panel of claim 15 wherein the fastener is selected from the group of screws, nails and rivets.

17. The structural panel of claim 1 wherein the connector is a sideways "U"-shaped connector having top and bottom leg portions.

18. The structural panel of claim 17 wherein the "U" connector is attached to the upper flange of the metal stud by a fastener passing through the bottom leg portion of the connector, the insulating panel and the upper flange of the stud.

19. The structural panel of claim 18 wherein the fastener is selected from the groups of screws, nails and rivets.

20. The structural panel of claim 1 wherein the connector is an "L"-shaped connector.

21. The structural panel of claim 1 wherein the outer surface of the concrete slab is textured.

22. The structural panel of claim 1 wherein the outer surface of the concrete slab is colored.

23. The structural panel of claim 1 further comprising between about ½ inch and about 6 inches of insulation between each of the studs.

24. A method of making a structural panel comprising:

arranging a plurality of studs substantially parallel to each other;

laying an insulating panel having substantially the same dimensions as the structural panel over the studs;

attaching one or more connectors, each connector having at least one hook portion, to the top flange of each stud, a portion of the connectors passing through the insulating panel, and wherein such connectors are not unitary with the studs;

laying a metal mesh over the connectors such that a hook portion of the connectors engages the metal mesh, and wherein the metal mesh does not come into direct contact with the metal studs;

forming a concrete mold extending above the insulating panel; and pouring cement into the concrete mold.

25. The method of claim 24 further comprising: texturing the surface of the cement during curing.

26. The method of claim 24 further comprising: coloring the surface of the cement during curing.

27. The method of claim 24 wherein the insulated panel is polystyrene foam.

28. The method of claim 24 wherein the metal mesh is a 2×2 inch mesh.

29. The method of claim 24 wherein the metal mesh is a steel mesh.

30. The method of claim 24 wherein the cement further comprises one or more additives selected from the group of strengtheners, weatherizers, anti-corrosion additives and colorants.

31. The method of claim 24 wherein the studs are 16 or 18 gauge galvanized steel.

32. The method of claim 24 wherein the insulating panel is about ¾ inch thick.

33. The method of claim 24 wherein the cement is poured to a thickness between about 1⅞ and 2¼ inches thick.

34. The method of claim 24 wherein the connector is selected from the group of "S", "C", "Z", and "L"-shaped connectors.

35. The method of claim 24 further comprising inserting a vapor barrier on a top surface of the insulating panel before attaching the connectors.

36. The method of claim 35 wherein the vapor barrier is polyethylene.

37. The method of claim 35 wherein the vapor barrier is a dimpled plastic.

38. The method of claim 24 comprising:

laying a stencil over all or a portion of the surface of the cement;

applying a colorant to the surface of the cement.

39. The method of claim 24 wherein the insulating panel has an exposed surface and an aluminum coating or sheeting on the exposed surface.

40. A method of constructing a building comprising:

attaching a plurality of the structural panels of claim 1 to each other to form a closed structure;

attaching each structural panel to a foundation.

41. The method of claim 40 wherein the foundation is a structural panel of claim 1.

* * * * *